United States Patent [19]

Bach

[11] Patent Number: 4,965,097

[45] Date of Patent: Oct. 23, 1990

[54] TEXTURIZED CELL MATERIAL FOR CONFINEMENT OF CONCRETE AND EARTH MATERIALS

[75] Inventor: Gary Bach, Appleton, Wis.

[73] Assignee: Reynolds Consumer Products, Inc., Appleton, Wis.

[21] Appl. No.: 295,890

[22] Filed: Jan. 11, 1989

[51] Int. Cl.[5] ..... E02D 29/00; E02D 5/03; E02B 3/04

[52] U.S. Cl. ..... 428/194; 428/188; 428/156; 428/117; 428/180; 428/178; 428/184; 428/516; 428/523; 428/688; 428/489; 405/258; 405/262; 405/16

[58] Field of Search ..... 405/258, 262, 16; 428/188, 194, 156, 117, 180, 178, 184, 516, 523, 685, 489

[56] References Cited

U.S. PATENT DOCUMENTS

| | | | |
|---|---|---|---|
| 1,905,176 | 4/1933 | Kieckhefer . | |
| 2,315,351 | 3/1943 | Schaefer | 405/258 |
| 3,269,125 | 8/1966 | Moore | 61/35 |
| 3,561,219 | 2/1971 | Nishizawa et al. | 61/38 |
| 3,954,377 | 5/1976 | Scholz et al. | 425/432 |
| 4,411,557 | 10/1983 | Booth | 405/262 X |
| 4,530,622 | 7/1985 | Mercer | 405/258 |
| 4,572,705 | 2/1986 | Vignon et al. | 405/16 |
| 4,619,560 | 10/1986 | Crinnion et al. | 405/284 |
| 4,728,227 | 3/1988 | Wilson et al. | 405/258 X |
| 4,778,309 | 10/1988 | Bach et al. | 405/258 |
| 4,798,364 | 1/1989 | Scott | 428/425.1 X |
| 4,798,498 | 1/1989 | Hallberg | 405/258 |
| 4,804,293 | 2/1989 | Varkonyi et al. | 405/15 |
| 4,837,387 | 6/1989 | Vande Pol | 405/258 X |

FOREIGN PATENT DOCUMENTS

| | | | |
|---|---|---|---|
| 0156326 | 12/1981 | Japan | 405/258 |
| 61-92218 | 5/1986 | Japan . | |
| 1058611 | 2/1967 | United Kingdom . | |
| 2078833 | 1/1982 | United Kingdom . | |

OTHER PUBLICATIONS

Brochure, "Geoweb-Grid Confinement System", Presto Products, Inc.

Article, "Reinforced Earth", The Reinforced Earth Company.

*Primary Examiner*—Ellis P. Robinson

*Assistant Examiner*—William P. Watkins, III

*Attorney, Agent, or Firm*—Willian Brinks Olds Hofer Gilson & Lione

[57] ABSTRACT

A cellular earth confinement material having texturized surfaces in the cells provides improved structural integrity and reduced long-term settlement in single layer and multilayer filled cell structures. The texturized earth confinement structures can be used with a wide variety of fill materials including sand, soil, cement, asphalt and gravel. The optimum texture of the surface varies depending on the size, shape, and type of fill particles, and the density of the fill.

16 Claims, 5 Drawing Sheets

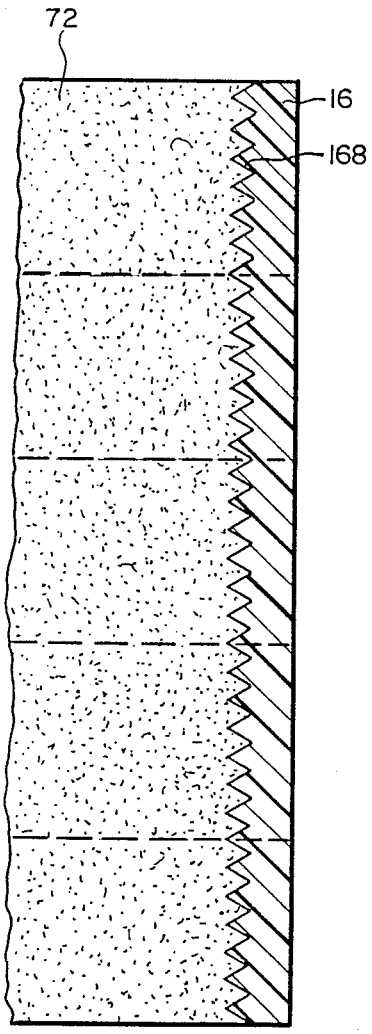
FIG. 8
FIG. 9
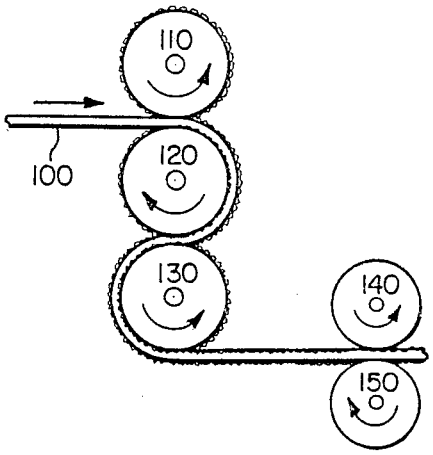

TEXTURIZED CELL MATERIAL FOR CONFINEMENT OF CONCRETE AND EARTH MATERIALS

BACKGROUND OF THE INVENTION

The present invention relates to a texturized cell material for confinement of concrete, asphalt, sand, soil and other earth materials. Specifically, the invention relates to a cell material having texturized surfaces on the cell walls.

A cell material used for soil confinement to provide a road base made from soils (sand, rounded rock, poorly graded aggregate, concrete and the like) has been known and used for some time. A prime example is Geoweb TM plastic soil confinement system, sold by Reynolds Consumer Products, Inc., P.O. Box 2399, Appleton, Wis. 54913 Geoweb TM cells made from plastic strips which are joined on their faces in a side by side relationship at alternating spacings so that when the strips are stretched out in a direction perpendicular to the faces of the strips, the resulting cell section is honeycomb-like in appearance, with sinusoidal or undulant shaped cells.

Voluminous reports have proved the ability of Geoweb TM cell material to support roadways. Geoweb TM cell material has also been used in applications where the cell layers are stacked on one another, such as a stepped back design for hill slope retention. Even free standing walls have been built with Geoweb cells. However, because the cells are completely enclosed on the sides, the ability of concrete and asphalt structures to withstand upward and downward pressure can be limited by the sometimes low frictional and/or adhesive forces between the fill material and the cell walls. Furthermore, gravel, soil and other earth materials can settle over a period of time, causing exposure of the uppermost portion of the cell material to traffic and sun.

SUMMARY OF THE INVENTION

The present invention provides a cell material having texturized surfaces on the inner walls of the cells. The texturized surfaces have been found to cause a surprising improvement in the load bearing capacities of cell structures filled with concrete, asphalt, and loose earth fills such as soil and sand. Furthermore, a surprising reduction in the long term settlement of loose fill materials has been found to result from these texturized surfaces. These features contribute to much improved structural integrities and longer useful lives of structures which are reinforced by cell material.

The texturized walls may have varying degrees of texture depending on the type of fill material used. If a loose fill material such as sand or soil is used, the size and shape of the fill particles will play an important role in determining the optimum texture. If a concrete or asphalt fill material is used, the surface texture of the fill and the bond strength between adjacent fill particles will be important factors in determining the optimum texture.

Depending on the application, the texturized cell material may either consist of a single layer of cells or a plurality of layers stacked on top of each other. The texture may be uniform throughout the structure or may be varied in any desired fashion.

The embodiments and advantages of the invention are further described in the following detailed description made with reference to the accompanying drawings.

BRIEF DESCRIPTION OF THE DRAWINGS

FIG. 8 is a sectional view of the concrete-filled cell structure of FIG. 7.

FIG. 9 illustrates a chill roll arrangement used for texturizing a plastic sheet for use in the texturized cell material of the invention.

DETAILED DESCRIPTION OF THE PREFERRED EMBODIMENTS

Figure 1:
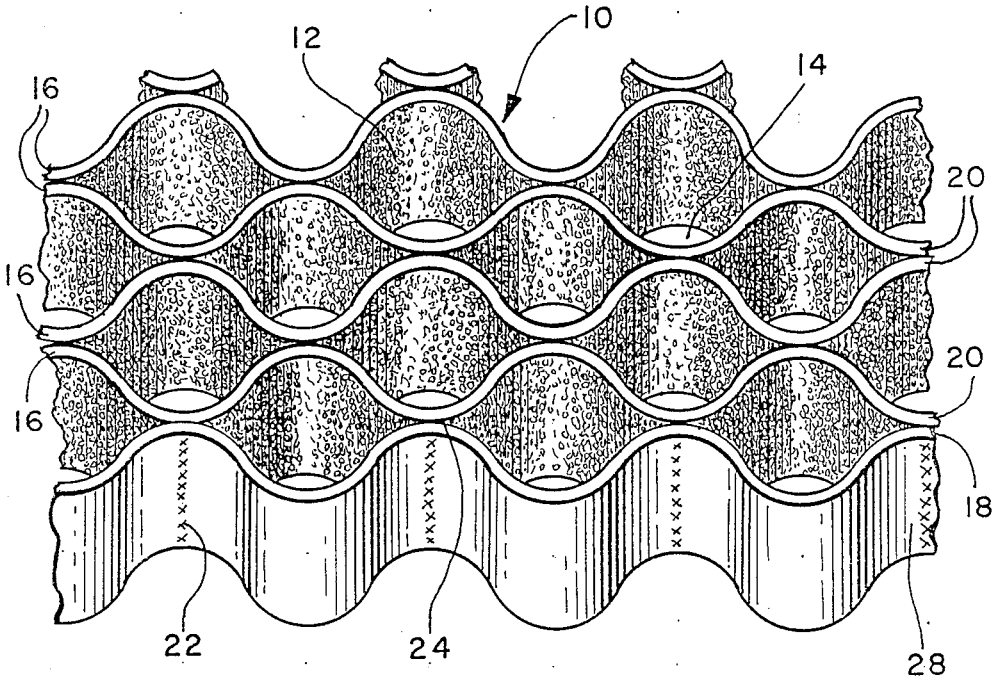
FIG. 1 is a perspective view of a single layer of the texturized cell material of the invention.

Referring to FIG. 1, a single-layer cell structure 10 is shown having texturized surfaces 12 on the inside walls of the cells 14. The cells 14 are preferably formed by first bonding a plurality of plastic strips 16 in a side by side relationship using the ultrasonic welding techniques discussed in U.S. Pat. Nos. 4,572,753 and 4,647,325, the entire disclosures of which are incorporated herein by reference. The bonding between strips may best be described by thinking of the strips 16 as being paired, starting with an outside strip 18 paired to an outermost inside strip 20, a pair of the next two inside strips 20, etc. The two strips 16 of each pair are preferably bonded together at bonding areas 22 located at substantially equal intervals along the length of the strips. Each pair of strips 16 is bonded to each adjacent pair at bonding areas 24 located about halfway between the bonding areas 22. The cell structure 10 can be formed by pulling the plurality of bonded plastic strips 16, causing the plastic strips to bend in a sinusoidal fashion.

Figure 2:
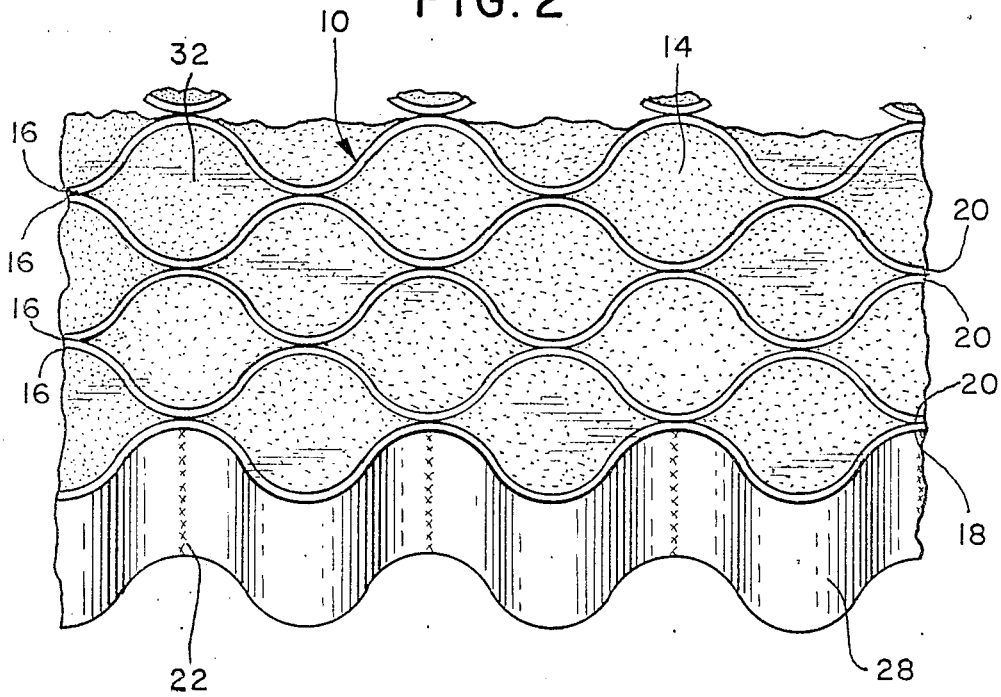
FIG. 2 shows the texturized cell material of the invention filled with sand.

The texturized surfaces 12 are preferably formed wherever the cell material 10 comes into contact with a fill material 32 such as sand as shown in FIG. 2. Accordingly, both surfaces of each inner plastic layer 20 and at least one surface of each outer plastic layer 18 should preferably be texturized. These surfaces form the inner walls of the cells 14. The outer surfaces 28 of the outer layers 18 may or may not be texturized depending on the application. For example, if the outer surfaces 28 are adjacent to an earth material such as sand or soil, texturization of the outer surfaces may help reduce settling of the earth material immediately adjacent to the cell structure relative to the fill material which is contained within the cells 14. If, on the other hand, the outer surfaces 18 are exposed, texturization of these surfaces may be aesthetically pleasing but would otherwise serve no useful purpose. An example of a filled structure having exposed outer surfaces is a concrete wall.

Texturizing of the plastic material can be accomplished using a variety of methods. In a preferred method, texturizing is accomplished during quenching of the plastic material immediately after extrusion. The plastic material is extruded using a sheet extrusion process and exits the die in a molten sheet form. The plastic sheet then passes between a series of texturized chill rolls where it is simultaneously quenched and texturized. In FIG. 9, for instance, polymer sheet 100 comprising a polyethylene composition exits the sheet extruder at a temperature of about 400° F. and initially passes between chill rolls 110 and 120 having texturized surfaces at temperatures of about 140° F. The polymer sheet 100 then winds around chill roll 130 which also has a texturized surface at a temperature of about 160° F. The polymer sheet 100 is then passed between two puller rolls 140 and 150, after which the sheet is cut into individual segments representing the plastic strips 16 shown in FIG. 1.

The texture of the chill rolls 110, 120, and 130 may be varied depending upon the texture desired for the surfaces of the plastic strips. Preferably, the chill rolls are close enough together that the polymer sheet 100 is "squeezed" between the chill rolls, thereby imprinting substantially all of the chill roll surface texture onto the surfaces of the polymer sheet 100. The preferred chill roll temperatures and speeds will vary depending on the type, thickness and temperature of the plastic material used.

In the embodiment which forms the basis for FIG. 1, each strip is about eight inches high and the welds 22 are formed at lengthwise intervals of about thirteen inches. Each weld 24 is about 6½ inches from a weld 22. FIG. 1 depicts a relatively coarse texture but the texture will vary depending on the fill material used and the density of the fill. The optimum texture (i.e. that which causes the greatest increase in load bearing capacity and/or reduction in long term settlement) depends on the size and shape of the fill particles and whether the fill particles are bonded together (e.g. concrete or asphalt) or are loose (e.g. dirt, gravel or sand).

Figure 6:
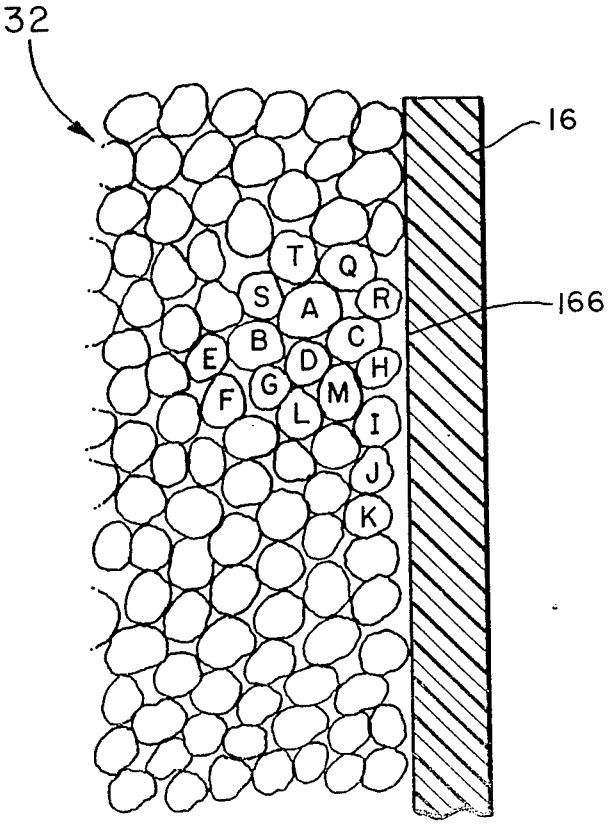
FIG. 6 shows an exploded sectional view of a sand-filled cell having smooth (nontexturized) walls.

FIGS. 3–6 illustrate how the optimum texture is determined for a particulate material 32 consisting primarily of substantially spherical sand particles. As illustrated in each of these figures, a typical sand will include a range of particle sizes which will line up in a somewhat irregular fashion when stacked on top on one another. This irregular distribution helps reduce long-term settlement of the sand by making it difficult for individual particles to move relative to one another. In FIG. 6, for instance, particle A is supported vertically by particles B, C, and D and cannot fall in a straight vertical fashion unless these supporting particles are displaced. Particle B is in turn supported vertically by particles E, F, and G, particle D is supported by particles G, L and M and so on. The number of supporting particles for each individual particle is actually much larger than shown in FIG. 6 due to the fact that FIG. 6 only shows two dimensions of a three-dimensional particle network.

As illustrated in FIG. 6, the particles immediately adjacent to the smooth wall 166 of the plastic strip 16 have less vertical supporting particles than the particles located away from the wall 166. Furthermore, the smooth wall 166 provides minimal vertical support. Finally, unlike the particles located away from the wall 166, the particles immediately adjacent to the wall 166 tend to line up vertically in a somewhat regular fashion. Both of these factors (less vertical support and less irregularity) make it much easier for particles adjacent to the wall such as H, I, J, and K to fall vertically. When the particles adjacent to the wall 166 fall, this ultimately lessens the support for the particles away from the wall and promotes overall settlement of the fill material. If particle H falls, for instance, particle C will also fall, as will particles Q and R. Particle A is then likely to fall downward and toward the wall 17, causing particle T to fall and reducing the vertical support of particle S. As the particles adjacent to the wall 166 continue to fall due to water erosion, compression or other physical agitation of the structure, the inside particles will tend to fall downward and toward the wall.

In other words, the surface conditions existing at the inside cell walls of the cell structure are a major determinant of long-term settlement rates for loose particulate fill materials contained within the cells. By varying these surfaces characteristics in accordance with the invention, this long-term settlement can be greatly reduced.

Figure 4:
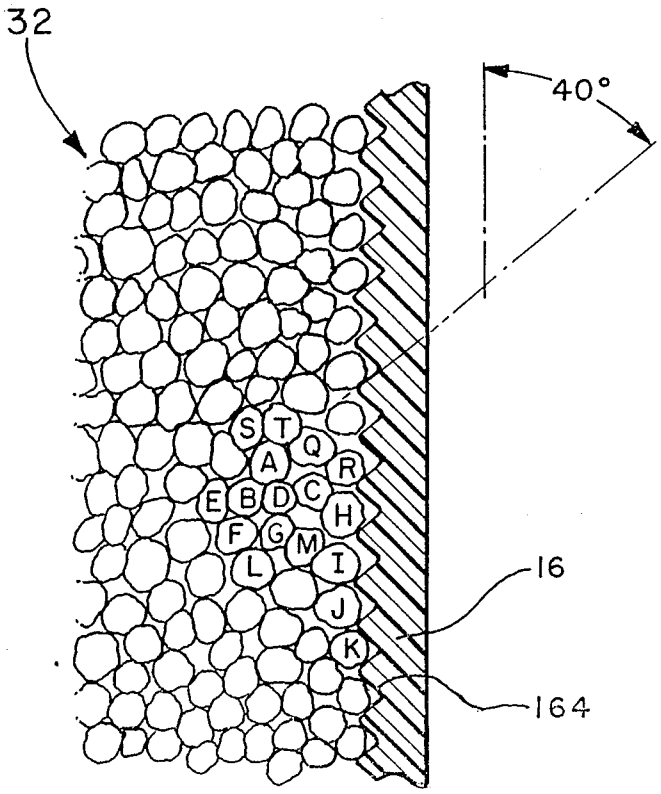
FIG. 3,4, and 5 are exploded sectional views of sand-filled texturized cells having various textures relative to the fill particle sizes.
Figure 3:
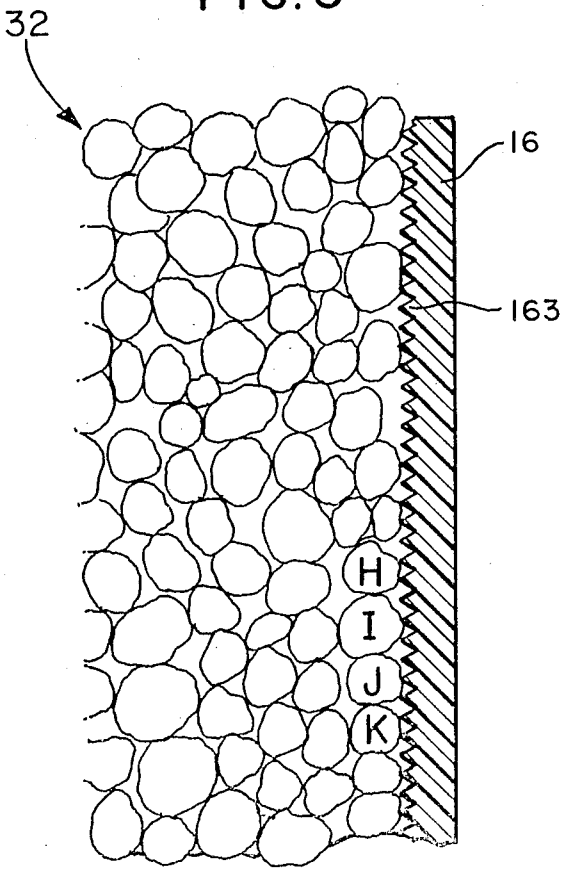

FIG. 3 depicts a texturized surface 163 having only a very slight texture relative to the sizes of the sand particles 32. The texturized surface 163 provides only minimal vertical support for particles such as H, I, J and K located adjacent to the surface. Furthermore, the particles adjacent to the structure 163 tend to line up vertically in the same fashion as when the surface is smooth. While the texturized surface 163 may cause some reduction in longer-term settlement, the effect would be minimal FIG. 4 depicts a texturized surface 164 having a medium texture relative to the sizes of the sand particles 32. Preferably, the texture will be such that the angle of friction between the texturized surface 164 and the adjacent particles (e.g. H, I, J, and K) is between about 20 degrees and about 60 degrees The angle of friction is the angle, measured from the vertical, at which a particle adjacent to the wall 164 touches the wall 164 at the lowermost point of contact. For a completely smooth surface such as illustrated in FIG. 6, the angle of friction will be zero degrees. For a particle resting on a horizontal ledge, the angle of friction would be 90 degrees. Most preferably, the texturized surface will be formed to give an angle of friction of about 40 degrees with the adjacent fill particles, though the optimum angle of friction may vary somewhat depending on the fill material.

By selecting the optimum texture for the surface 164, the adjacent particles (e.g. H, I, J and K) will generally not touch one another but will be somewhat spaced apart in the vertical direction. This vertical spacing should be such that the first layer of particles adjacent to the wall supports the second layer of particles in a manner similar to that by which the wall supports the first layer of particles. For example, particle I will ideally be spaced from particle H at a sufficient distance to allow particle M to fit between particles H and I such as to have substantial vertical support from particle I. Preferably, the vertical space between particle H and I will be such that the angle of friction between particle M and particle I is between 20 degrees and about 60 degrees, most preferably about 40 degrees.

In other words, if the texture is properly selected relative to the particle sizes, the optimum angle of friction present between the surface 164 and the first adjacent particle layer will also be present between the first and second particle layers, between the second and third particle layers, and so on. The result is a major reduction in long-term settlement for the particle-filled cell structure.

Figure 5:
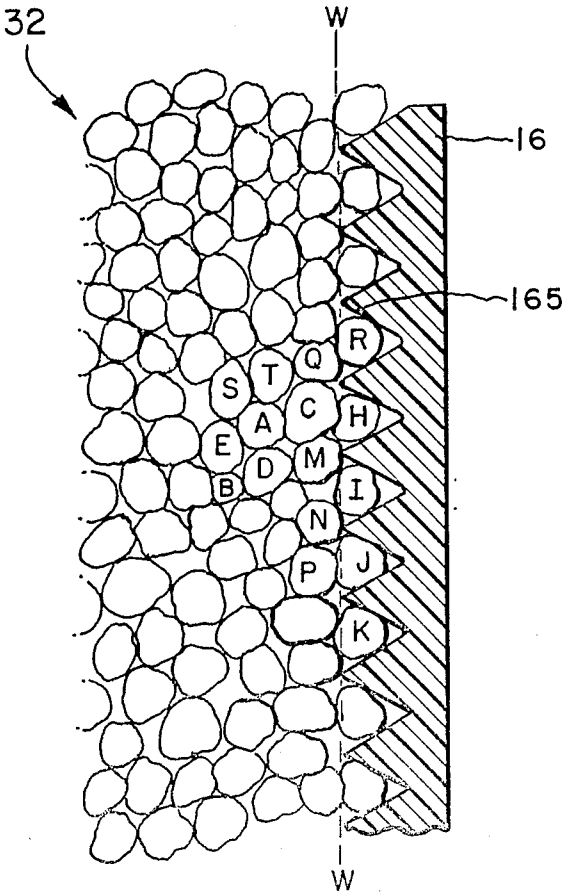

If the texturized surface has a coarse texture relative to the fill particle size, the optimum angle of friction will occur only between the wall surface and the adjacent particle layer and will not be transmitted to the second or third layers. This situation is illustrated in FIG. 5. The texture of the surface 165 is so coarse that adjacent particles such as R, H, I, J and K become substantially embedded in the wall and behave as if they were part of the original wall. While the angle of friction between the wall 165 and these particles is substantial, there is essentially no angle of friction between the first layer of particles (R, H, I, J and K) and the second layer of particles (Q, C, M, N and P). In effect, a new "wall" is formed along the dotted line W—W which has a much smoother surface than the depicted wall 165 and which includes the first layer of sand particles as part of its structure. The reduction in long-term settlement of the particulate fill material would be minimal under these circumstances.

Figure 7:
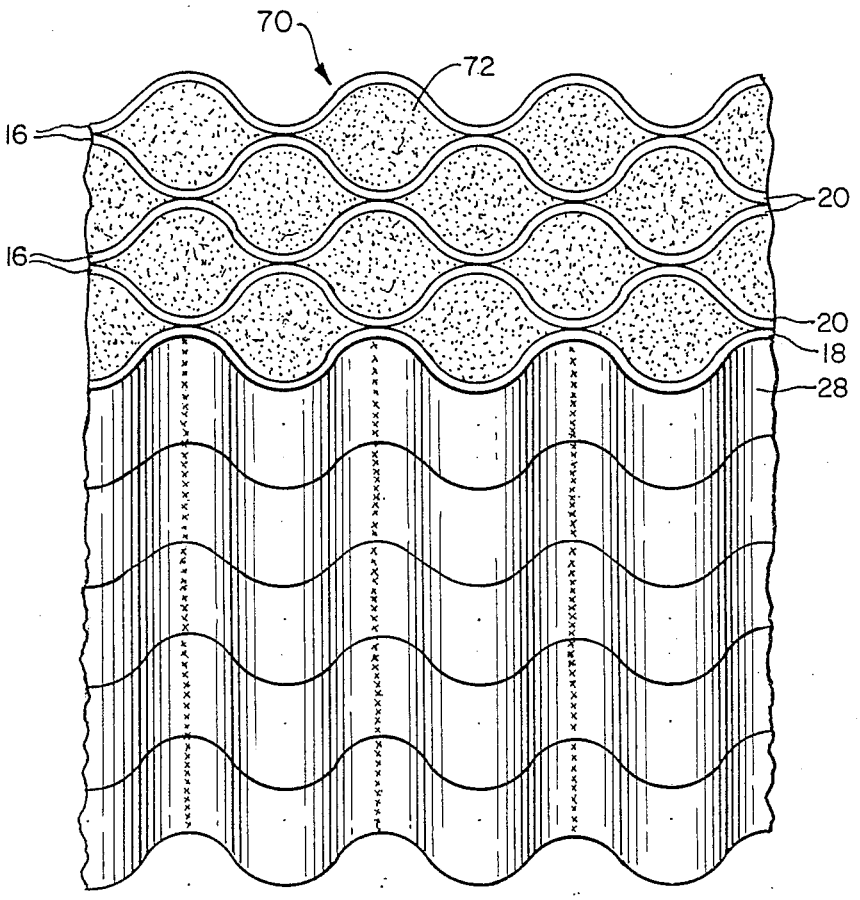
FIG. 7 is a perspective view of a concrete wall built using multiple layers of the texturized cell material of the invention.

FIGS. 7 and 8 illustrate the use of a cell material having a relatively coarse texture for reinforcement of a multi-layer concrete structure 70. Preferably, the layers of cell material are stacked upon one another using the notching techniques disclosed in U.S. application Ser. No. 07/032,278, the entire disclosure of which is incorporated herein by reference. By utilizing a relatively coarse texturized cell material, separation between the cell walls 168 and the concrete fill material 72 under conditions of high stress is substantially reduced. The resulting improvement in overall structural integrity greatly increases the capacity of the filled structure to withstand pressure and impact of both vertical and horizontal origins.

Because the fill particles are bonded together, the optimum texture is not based on individual particle size, but is instead a function of both the surface texture and the integrity of the concrete structure. If the concrete structure is strong, it may be desirable to utilize a cell material whose texture is very coarse relative to fill particle size as shown in FIG. 8, provided that the portions of concrete extending into the plastic layer 16 are not likely to break off.

In addition to the multi-layer concrete wall shown in FIGS. 7 and 8, the texturized cell material of the invention also has useful application in single layer concrete or asphalt structures. A paved roadway, for example, would benefit from the increased load bearing capacity (i.e. ability to withstand vertical pressure) provided by the texturized cell material of the invention. The result would be a substantial improvement in the ability of the roadway to withstand heavy truck traffic and to resist buckling and pothole formation caused by changing weather conditions.

While the preferred embodiments of the invention have been disclosed, it is understood that the invention is not limited to the disclosed examples. For instance, different fill materials may be used including gravel, soil and other earth materials. The type of fill material and the configuration of the cell material, including the size of the plastic strips and the coarseness of the surfaces, will vary depending on the use. Modifications in addition to those discussed can be made without departing from the scope of the invention.

The scope of the invention is indicated in the appended claims. All changes that come within the meaning and range of equivalency of the claims are intended to be embraced therein.

We claim:

1. A cell material structure for confinement of earth material, comprising:

a plurality of plastic strips bonded together on their faces in a side by side relationship at bonding areas which are staggered from strip to strip such that the plurality of strips may be stretched in a direction perpendicular to the faces of the strips to form a layer of cells open at the top and bottom;

said strips comprising two outside strips and one or more inside strips;

said strips comprising at least one texturized surface having a texture which creates an angle of friction of about 20 degrees to about 60 degrees between the surface and the adjacent fill material.

2. The cell material structure of claim 1 wherein each inside strip comprises two texturized surfaces.

3. The cell material structure of claim 1 wherein each outside strip comprises at least one texturized surface.

4. The cell material structure of claim 1 wherein the texturized surface comprises a medium texture relative to a fill particle size.

5. The cell material structure of claim 1 wherein the texturized surface comprises a coarse texture relative to a fill particle size.

6. A cell material structure comprising at least two layers of the cell material of claim 1 stacked in a vertical fashion.

7. The cell material structure of claim 6 wherein the inside strips have top and bottom edges which are notched such that the cell material layers stacked upon one another rest with portions of the cell walls on a perimeter of the cell material layers overlapping each other.

8. The cell material structure of claim 1 wherein each strip has a width of about eight inches and is bonded to an adjacent strip at lengthwise intervals of about 6½ inches and to each adjacent strip at lengthwise intervals of about 13 inches.

9. The cell material structure of claim 1 further comprising:

a fill material within the cells.

10. The cell material structure of claim 9 wherein the fill material comprises cement.

11. The cell material structure of claim 9 wherein the fill material comprises asphalt.

12. The cell material structure of claim 9 wherein the fill material comprises soil.

13. The cell material structure of claim 9 wherein the fill material comprises sand.

14. The cell material structure of claim 9 wherein the fill material comprises gravel.

15. The cell material of claim 1 wherein the angle of friction is about 40 degrees.

16. The cell material structure of claim 9 comprising at least two layers of filled cell material stacked in a vertical fashion.

* * * * *